US009601006B2

(12) United States Patent
Evans

(10) Patent No.: US 9,601,006 B2
(45) Date of Patent: Mar. 21, 2017

(54) UNIVERSAL REMOTE CONTROL WITH AUTOMATIC STATE SYNCHRONIZATION

(71) Applicant: Roku, Inc., Saratoga, CA (US)

(72) Inventor: Don P. Evans, Beaverton, OR (US)

(73) Assignee: Roku, Inc., Los Gatos, CA (US)

( * ) Notice: Subject to any disclaimer, the term of this patent is extended or adjusted under 35 U.S.C. 154(b) by 0 days.

(21) Appl. No.: 14/814,217

(22) Filed: Jul. 30, 2015

(65) Prior Publication Data

US 2017/0032665 A1 Feb. 2, 2017

(51) Int. Cl.
*G08C 19/16* (2006.01)
*G08C 17/02* (2006.01)

(52) U.S. Cl.
CPC ..... *G08C 17/02* (2013.01); *G08C 2201/20* (2013.01); *G08C 2201/92* (2013.01)

(58) Field of Classification Search
CPC ..... G08C 17/02; G08C 23/04; G08C 3/0383; G08C 2201/92; G08C 2201/40; G08C 2201/41; G08C 2201/20; H04N 21/4126; H04N 5/4403; H04N 21/42207; H04N 2005/4425; G06F 3/0383; H05B 37/0272; H04B 1/202
USPC ..... 455/41.2; 340/12.22
See application file for complete search history.

(56) References Cited

U.S. PATENT DOCUMENTS 8,031,270 B1 10/2011 Wisniewski et al.
8,624,713 B2 1/2014 Van Vleck et al.
2005/0101314 A1* 5/2005 Levi ..... H04L 63/0861 455/423
2009/0201422 A1 8/2009 Eshleman
2010/0201891 A1* 8/2010 Laroia ..... G08C 17/00 348/734
2010/0289685 A1 11/2010 Pratt et al.
2012/0051545 A1* 3/2012 Kudelski ..... G06F 21/10 380/270
2012/0326852 A1 12/2012 Harris et al.
2014/0203920 A1 7/2014 Baker et al.
(Continued)

FOREIGN PATENT DOCUMENTS

WO WO 2014/134671 A1 9/2014

OTHER PUBLICATIONS

International Search Report and Written Opinion directed to related International Patent Application No. PCT/US2016/044052, mailed Oct. 21, 2016; 12 pages.

*Primary Examiner* — Tesfaldet Bocure
(74) *Attorney, Agent, or Firm* — Sterne, Kessler, Goldstein & Fox PLLC

(57) ABSTRACT

Disclosed herein are system, method, and computer program product embodiments for synchronizing a state change at a universal remote control. An embodiment operates by sending a state change of the universal remote control to a remote-controlled device. The universal remote control then receives a confirmation message from the remote-controlled device. The universal remote control then updates a state configuration for the remote-controlled device in the universal remote control based on the sent state change. Because the universal remote control exchanges state change information with the remote-controlled device, the universal remote control does not become out of synchronization with the remote-controlled device which minimizes synchronization time and reduces user experience frustration.

20 Claims, 4 Drawing Sheets

(56) References Cited

U.S. PATENT DOCUMENTS

| | | | | |
|---|---|---|---|---|
| 2015/0091708 | A1* | 4/2015 | Tan | G08C 17/02 340/12.5 |
| 2015/0172586 | A1 | 6/2015 | Jung | |
| 2015/0243163 | A1* | 8/2015 | Shoemake | G08C 23/02 367/197 |

* cited by examiner

UNIVERSAL REMOTE CONTROL WITH AUTOMATIC STATE SYNCHRONIZATION

BACKGROUND

A universal remote control may be a remote control that can be programmed to operate various brands of one or more types of remote-controlled devices. One benefit of using a universal remote is that because it can control multiple devices, a universal remote may reduce the number of remote controls a user needs to keep readily accessible to control their devices. However, universal remote controls often become out of sync with a remote-controlled device because not all of the commands were received at the remote-controlled device from the universal remote control. For example, if the universal remote control sends infrared commands, which is a common remote control method, the universal remote may require line-of-sight accessibility to the remote-controlled device. If this line-of-sight is blocked, some or all of the infrared commands may not be received by the remote-controlled device. Accordingly, if a user pushes a button on the universal remote control to perform a sequence of commands on the remote-controlled device, there is no way for the universal remote control to know if the sequence of commands was actually performed. Similarly, if a user pushes a button on the remote-controlled device itself to perform a sequence of commands (e.g. changing the input, power, volume, etc.) on the remote-controlled device, there is no way for the universal remote control to know of the state change of the remote-controlled device. When the universal remote control becomes out of sync with a remote-controlled device, a user must resynchronize the universal remote control with the remote-controlled device. But this process is time consuming and error-prone.

In addition, universal remote controls have several other problems. First, universal remote controls may require a user to know the devices they want to control. For example, to program universal remote controls, a user may need to know the exact make and model numbers of the devices they wish to control. Second, universal remote controls typically need to have the command set that correlates to those devices. In other words, the universal remote control would need the ability to actually be able to control the devices a user has, which may not always be possible if the user has a newer device and the universal remote control is not updateable. Finally, universal remote control programming may be complicated. Typically, to program such controls users may consult tables in the user manuals for the controls that correlate programming codes to makes and model numbers of devices. This programming process is often very complicated for the user, especially if sequences of commands are necessary to perform the programming process.

BRIEF DESCRIPTION OF THE DRAWINGS

The accompanying drawings are incorporated herein and form a part of the specification.

In the drawings, like reference numbers generally indicate identical or similar elements. Additionally, generally, the left-most digit(s) of a reference number identifies the drawing in which the reference number first appears.

DETAILED DESCRIPTION

Provided herein are system, method and/or computer program product embodiment, and/or combinations and sub-combinations thereof, for ensuring a universal remote control and a remote-controlled device remain synchronized. An embodiment operates by transmitting a state change message from the universal remote control to the remote-controlled device in response to a user inputting a command, or series of commands, to control the remote-controlled device at the universal remote control. The state change message may be transmitted over a different communication link than the communication link used to transmit the command, or series of commands, to control the remote-controlled device. The state information for the remote-controlled device in the universal remote control is updated based on receipt of a state change confirmation message from the remote-controlled device. The state change confirmation reflects whether the remote-controlled device successfully performed the command, or series of commands, inputted by the user. Accordingly, because the stored state information for the remote-controlled device in the universal remote control is only updated upon the remote-controlled device successfully performing the inputted command, or sequence of commands, the universal remote control does not become out of synchronization with the remote-controlled device. This minimizes time spent synchronizing the universal remote control with the remote-controlled device. Furthermore, this reduces user frustration resulting from the universal remote control becoming out of synchronization with the remote-controlled device.

Figure 1:
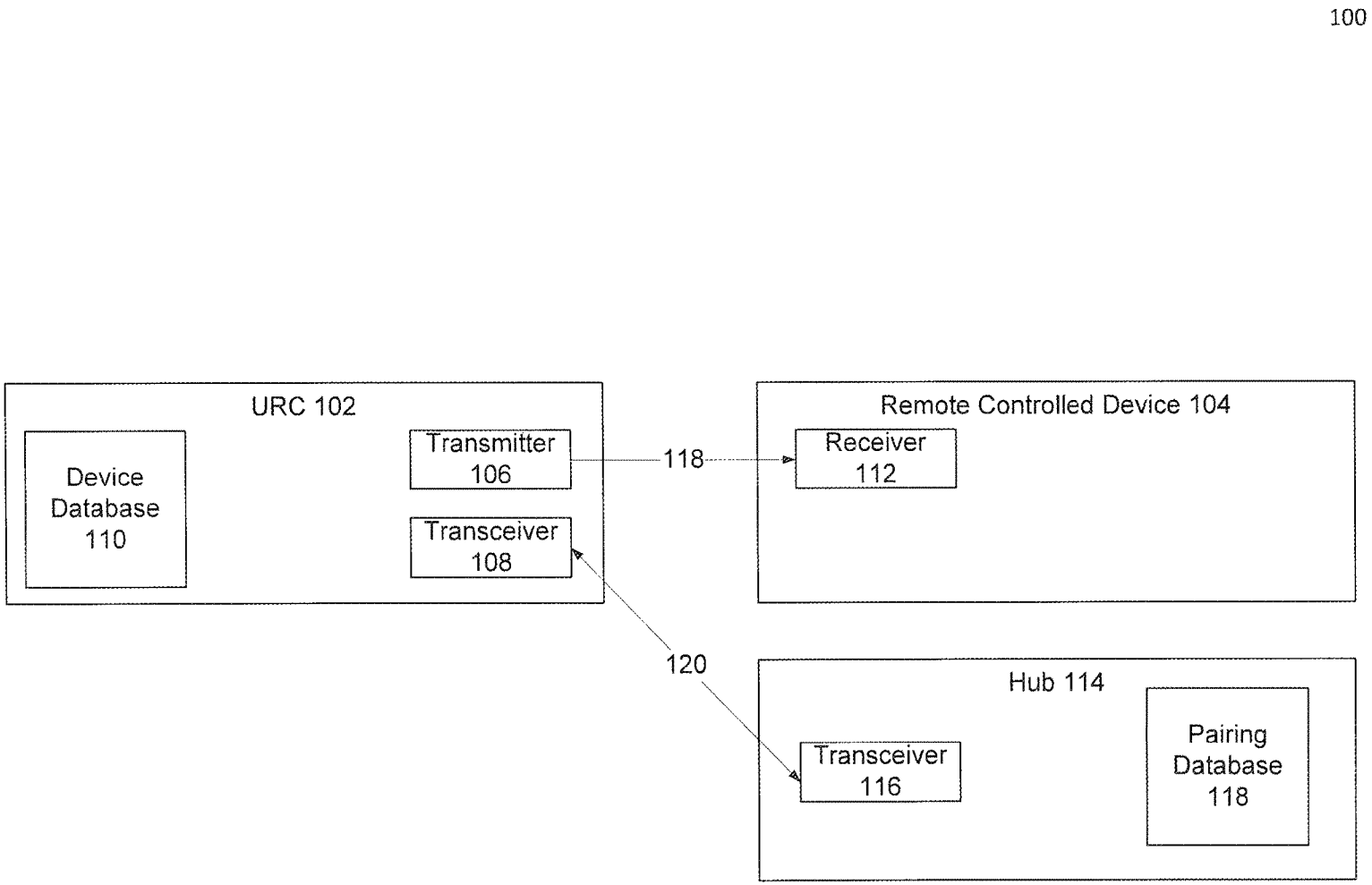
FIG. 1 is a block diagram of a universal remote control system, according to an example embodiment.

FIG. 1 illustrates a universal remote controlled system 100, according to an example embodiment. Universal remote controlled system 100 includes a universal remote control (URC) 102 and remote-controlled device 104. In universal remote controlled system 100, URC 102 may be in proximity to remote-controlled device 104.

In FIG. 1, URC 102 may refer to a remote control configured to control multiple remote-controlled devices 104. URC 102 is operable to communicate requests or commands wirelessly to remote-controlled device 104 using infrared (IR) or radio frequency (RF) signals. URC 102 may be reprogrammed to communicate requests or commands to a new remote-controlled device 104.

In FIG. 1, remote-controlled device 104 may refer to a piece of consumer electronics equipment. For example, remote-controlled device 104 may be a television, set top box, audio/video (AV) receiver, digital versatile disc (DVD) player, Blu-ray Disc (BD) player, cable box, media streaming player, or other consumer electronics device. Remote-controlled device 104 may be controllable by remote control. Remote-controlled device 104 may be suitable for control by URC 102. Remote-controlled device 104 may also represent an existing instrument or device that is in use but not yet controllable using URC 102. This is because URC 102 may not yet be configured to control remote-controlled device 104.

Remote-controlled device 104 may receive requests or commands from URC 102 over communication link 118 using IR or RF signals. Communication link 118 may be a unidirectional communication link. Specifically, URC 102 may send requests or commands over communication link 118 to remote-controlled device 104, but remote-controlled device 104 may not be operable to send requests or commands over communication link 118 to URC 102.

URC 102 may send requests or commands over communication link 118 to remote-controlled device 104 according to a command set. A command set may include all the commands that URC 102 may need to control remote-controlled device 104. A command set may be a code or set of codes specific to a given remote-controlled device 104. For example, a command set may be based on the manufacturer of a remote-controlled device 104. A command set enables URC 102 to communicate with multiple different remote-controlled devices 104. A command set also enables a remote-controlled device 104 to determine whether URC 102 is sending requests or commands to it or a different remote-controlled device 104.

URC 102 may store command sets in device database 110 for communication with one or more remote-controlled devices 104. Device database 110 may be a computer memory (e.g. dynamic random access memory, static random access memory, flash memory, etc.) that stores one or more command sets associated with one or more remote-controlled devices 104 in universal remote controlled system 100.

URC 102 may include a transmitter 106. Transmitter 106 may send requests or commands (e.g. in the form of codes or instructions) over communication link 118. URC 102 may also include a transceiver 108. Transceiver 108 may send and receive state change information over communication link 120.

Remote-controlled device 104 may include a receiver 112. Receiver 112 may receive requests or commands over communication link 118 from URC 102. Remote-controlled device 104 may also include hub 114. Hub 114 includes a transceiver 116. Transceiver 116 may send and receive state change information over communication link 120.

In an embodiment, remote-controlled device 104 may be controlled with an original remote control. This original remote control may be specifically configured to control remote-controlled device 104. Remote-controlled device 104 may also be controlled via buttons (not depicted) located on remote-controlled device 104.

In FIG. 1, URC 102 may communicate with remote-controlled device 104 via communication link 120. Communication link 120 may be used to receive commands (e.g. in the form of codes or instructions) from URC 102. Communications link 120 may also be used to reprogram (e.g. reconfigure) URC 102 to send different commands or to control different equipment. For example, communications link 120 may be used to reprogram URC 102 to use a command set corresponding to a different remote-controlled device 104. Communications link 120 may also be used to limit or delete existing remote-controlled devices 104 for which URC 102 may be programmed.

In FIG. 1, after URC 102 has been configured with at least a programming code corresponding to remote-controlled device 104, URC 102 may communicate via communication link 118 with remote-controlled device 104. Specifically, URC 102 may emulate at least some functionality that an original remote control for remote-controlled device 104 is capable of performing over communication link 118. From the perspective of remote-controlled device 104, the requests or commands received over communication link 118 may appear identical or indistinguishable to the original remote control. In other words, remote-controlled device 104 may not be aware that URC 102 is emulating the original remote control, and may respond to the requests or commands received over communication link 118 in an identical manner as with the original remote control.

In FIG. 1, URC 102 may be configured with programming codes corresponding to multiple remote-controlled devices 104. After URC 102 has been configured with these programming codes, URC 102 may communicate via communication link 118 with the multiple remote-controlled devices 104. Because URC 102 is programmed to operate multiple remote-controlled devices 104, only URC 102 is needed to send requests or commands to the multiple remote-controlled devices 104. The original remote controls of the multiple remote-controlled devices 104 may not be needed to control them. The user experience is simplified because URC 102 may replace the multiple original remote controls.

In an embodiment, URC 102 may be configured to perform a sequence of commands (e.g. a macro) when a user presses a button or performs an action using URC 102. URC 102 may expand this macro command into a set of instructions to perform a particular task. In an embodiment, the macro command may comprise a set of instructions for an individual remote-controlled device 104. In another embodiment, the macro command may comprise a set of instructions for multiple remote-controlled devices 104.

In an embodiment, URC 102 may perform a macro command in order to simplify common tasks for a user. This may occur when a task involves multiple remote-controlled devices 104. For example, playing a DVD movie is a common task that involves multiple remote-controlled devices 104. Specifically, playing a DVD movie may involve powering on the television, DVD player, and A/V receiver. The user may then have to change the inputs on the television and A/V receiver.

In an embodiment, this sequence of tasks may be performed individually by selecting the appropriate remote-controlled device 104 and executing the appropriate command using URC 102. In another embodiment, this sequence of tasks may be performed as a macro command by URC 102. Specifically, when a user performs the macro command at URC 102, URC 102 will power on the required remote-controlled devices 104, power off the remote-controlled devices 104 not needed, and change the inputs on the remote-controlled devices 104.

But often when a macro command is performed by URC 102, the associated task will not be performed. This may happen when URC 102 sends the multiple commands of the macro command to the remote-controlled devices 104 but one or more of the remote-controlled devices 104 do not receive some of the commands. URC 102 may then become out of sync with the remote-controlled devices 104. For example, URC 102 may think that one of the remote-controlled devices 104 is powered on when it is actually powered off.

URC 102 often becomes out of sync with a remote-controlled device 104 when URC 102 communicates over communication link 118 with the remote-controlled 104 using IR signals. This is because IR signals often require line-of-sight between URC 102 and the remote-controlled device 104 for successful transmission. URC 102 may become out of sync with the remote-controlled devices 104 when using IR signals when an object moves between URC 102 and the remote-controlled devices 104 when performing a macro command. URC 102 may become out of sync with the remote-controlled devices 104 when using IR signals when URC 102 is pointed away from the remote-controlled device 104 when performing a macro command. URC 102 may become out of sync with the remote-controlled devices 104 when using IR signals when an object is blocking the line-of-sight between URC 102 and the remote-controlled device 104. URC 102 may become out of sync with the remote-controlled devices 104 when a user changes the state of a remote controlled device 104 directly on device itself.

URC 102 is therefore out of sync with a remote-controlled device 104 when the state of the remote-controlled device 104 is different than the current state of the remote-controlled device 104 maintained in URC 102. When URC 102 becomes out of sync with a remote-controlled device 104, a user may have to perform a resynchronization process between URC 102 and remote-controlled device 104. This is time consuming and error prone for a user.

In an embodiment, universal remote controlled system 100 maintains state synchronization between URC 102 and remote-controlled devices 104. In an embodiment, URC 102 may communicate with a remote-controlled device 104 using two distinct communication pathways as depicted in universal remote controlled system 100. A first pathway is communications link 118 discussed above. Communications link 118 represents a unidirectional communications link between URC 102 and a remote-controlled device 104. URC 102 may send commands and requests via communications link 118 to a remote-controlled device 104. But a remote-controlled device 104 may not send commands and requests via communications link 118 to URC 102.

In an embodiment, communication link 118 may use IR signals. In another embodiment, communications link 118 may use RF signals. URC 102 may be configured with at least a programming code corresponding to a remote-controlled device 104. URC 102 may send requests and commands via communications link 118 to a remote-controlled device 104 according to the configured programming code.

Because communications link 118 is unidirectional, URC 102 may not know that a request or command sent via communications link 118 to a remote-controlled device 104 is actually performed. While URC 102 may maintain state information corresponding to the state of a remote-controlled device 104, this state information may be inaccurate as discussed above.

In an embodiment, URC 102 may maintain accurate state information corresponding to the state of a remote-controlled device 104, and therefore will not become out of sync with the remote-controlled device 104. URC 102 may maintain this accurate state information by using a second communication link between URC 102 and a remote-controlled device 104. This second communication link is communications link 120. Communications link 120 may represent a bidirectional communications link between URC 102 and a remote-controlled device 104. URC 102 may send state change information via communications link 120 to a remote-controlled device 104, and remote-controlled device 104 may send state change information via communications link 120 to URC 102.

In an embodiment, communication link 118 may use IR signals. In another embodiment, communications link 118 may use RF signals. For example, communication link 118 may be WiFi connection (e.g. IEEE 802.11b, IEEE 802.11g, IEEE 802.11a, etc.). URC 102 may be configured with at least some connection configuration information corresponding to remote-controlled device 104. URC 102 may send commands via communications link 118 to remote-controlled device 104 according to the configured connection information.

Because communications link 120 is bidirectional, URC 102 may determine whether a command sent via communications link 118 to remote-controlled device 104 was actually performed. Specifically, URC 102 may determine whether the state information stored at URC 102 for remote-controlled device 104 is the same as the actual state of remote-controlled device 104. This enables universal remote controlled system 100 to ensure that URC 102 does not become out of sync with a remote-controlled device 104.

In an embodiment, every time URC 102 sends a request or command to a remote-controlled device 104 via communications link 118, URC 102 may also send a state change message via communications link 120 to the remote-controlled device 104. URC 102 may then wait for a confirmation message from the remote-controlled device 104 via communications link 120. In order to prevent the storage of inconsistent state information at URC 102, URC 102 will not change the state information corresponding to a remote-controlled device 104 until after receipt of the confirmation message from the remote-controlled device 104.

In another embodiment, a remote-controlled device 104 may periodically send a state update message via communications link 120 to URC 102. URC 102 may then update the state information at URC 102 corresponding to remote-controlled device 104 based on the state update message. As would be appreciated by a person of ordinary skill in the art, a remote-controlled device 104 may maintain pairing connection information corresponding to URC 102 at remote-controlled device 104. As would be appreciated by a person of ordinary skill in the art, the pairing connection information may be established during an initial synchronization operation between URC 102 and a remote-controlled device 104. In an embodiment, pairing connection information may be stored in pairing database 118 at hub 114. Pairing database may be a computer memory (e.g. dynamic random access memory, static random access memory, flash memory, etc).

In another embodiment, every time the state of a remote-controlled device 104 is directly changed at remote-controlled device 104, remote-controlled device 104 may send a state change message via communications link 120 to URC 102. As would be appreciated by a person of ordinary skill in the art, remote-controlled device 104 may maintain pairing connection information corresponding to URC 102 at remote-controlled device 104. As would be appreciated by a person of ordinary skill in the art, the pairing connection information may be established during an initial synchronization operation between URC 102 and remote-controlled device 104. In an embodiment, pairing connection information may be stored in pairing database 118 at a hub 114. Pairing database 118 may be a computer memory (e.g. dynamic random access memory, static random access memory, flash memory, etc.).

In another embodiment, a multimedia device may be connected to a remote-controlled device 104 using a multimedia interface. For example, in an embodiment, a multimedia device may be connected to a remote-controlled device 104 using a High-Definition Multimedia Interface (HDMI) cable. In an embodiment, every time there is a state change at the multimedia device, the state change information is transmitted to the remote-controlled device 104 using the multimedia interface. For example, the state of the multimedia device may be changed by a user at the multimedia device. The multimedia device may then send the state change information to the remote-controlled device 104 using the multimedia interface. In an embodiment, the state change information may be sent in the form of HDMI- CEC messages. The remote-controlled device 104 may then send the state change information for the multimedia device to URC 102. As would be appreciated by a person of ordinary skill in the art, a multimedia device may send the state change information based on a device specific code for the multimedia device. For example, in an embodiment, a multimedia device may send state change information to a remote-controlled device 104 using a HDMI cable based on a manufacture code associated with the multimedia device.

Moreover, as would be appreciated by a person of ordinary skill in the art, the remote-controlled device 104 may maintain pairing connection information corresponding to URC 102 at the remote-controlled device 104. This pairing connection information may be established during an initial synchronization operation between URC 102 and the remote-controlled device 104. In an embodiment, pairing connection information may be stored in pairing database 118 at the hub 114. Pairing database 118 may be a computer memory (e.g. dynamic random access memory, static random access memory, flash memory, etc.).

By transferring state change information from the multimedia device to the remote-controlled device 104 using the multimedia interface, the multimedia device does not require a communication link 120 between the multimedia device and URC 102. Similarly, the multimedia device does not require a transceiver 116. Instead, in an embodiment, the multimedia device may use a remote-controlled device 104 as an intermediary to transfer state changes to URC 102.

In an embodiment, if there is an actively paired URC 102 with a remote-controlled device 104, then the remote-controlled device 104 may wait for a confirmation message from URC 102 via communications link 120. In order to prevent inconsistent state information from being stored at a remote-controlled device 104, the remote-controlled device 104 may not change the state information at remote-controlled device 104 until after receipt of the confirmation message from URC 102.

Figure 2:
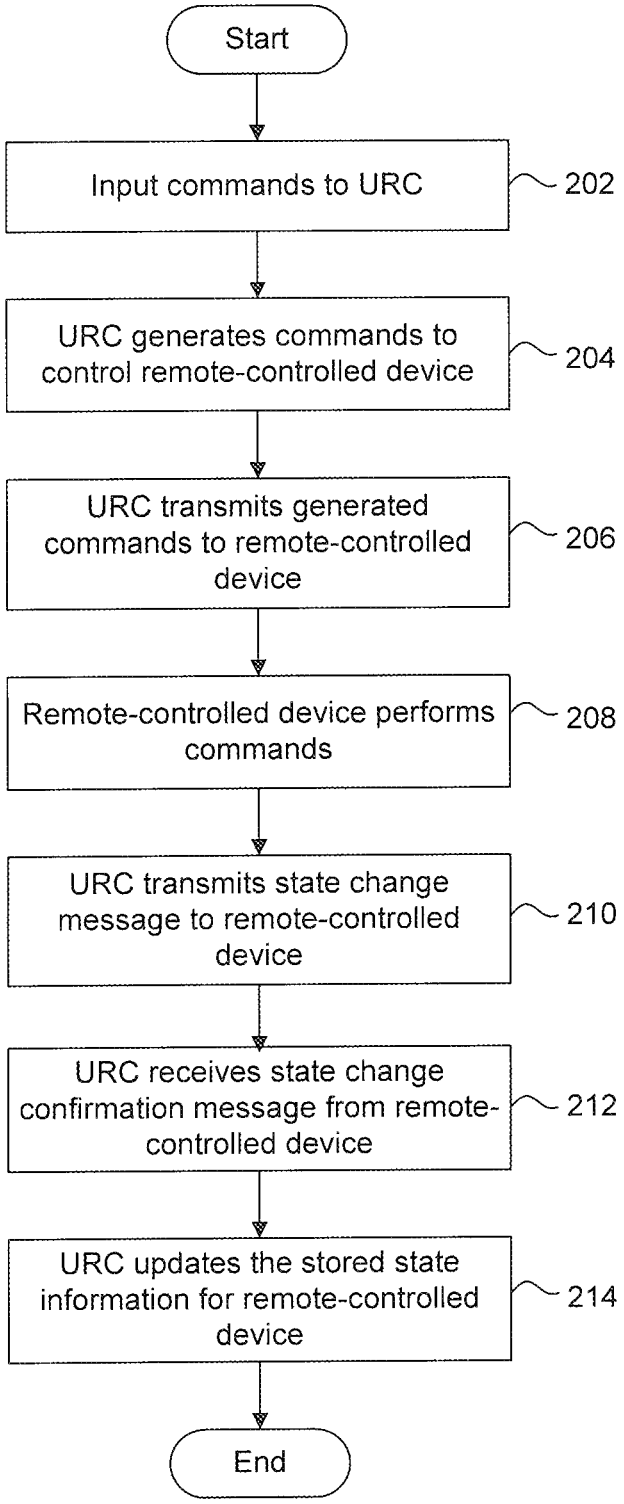
FIG. 2 is a flowchart illustrating a process for maintaining synchronization of a universal remote control with a remote-controlled device, according to an example embodiment.

FIG. 2 is a flowchart for a method 200 for maintaining synchronizing of a universal remote control with a remote-controlled device based on a state change at the remote-controlled device, according to an example embodiment. Method 200 is described with reference to FIG. 1. Method 200 can be performed by processing logic that can comprise hardware (e.g., circuitry, dedicated logic, programmable logic, microcode, etc.), software (e.g., instructions run on a processing device), or a combination thereof.

In step 202 of FIG. 2, a user inputs a command, or sequence of commands, to URC 102. In an embodiment, the user may input the command, or sequence of commands, by pressing one or more buttons on URC 102. In another embodiment, the user may input the command, or sequence of commands, by using a touch screen on URC 102. As would be appreciated by a person of ordinary skill in the art, the user may input the command, or sequence of commands, to URC 102 using various other mechanisms.

In step 204 of FIG. 2, URC 102 generates a command, or sequence of commands, to control remote-controlled device 104 based on commands inputted by the user in step 202. In an embodiment, the generated command, or sequence of commands, may be based on a device specific code for remote-controlled device 104. As would be appreciated by a person of ordinary skill in the art, URC 102 may be programmed with the device specific code for remote-controlled device 104 via various mechanisms.

In step 206 of FIG. 2, URC 102 transmits the generated command, or sequence of commands, of step 204 over communication link 118 to remote-controlled device 104 using transmitter 106. In an embodiment, remote-controlled device 104 may receive the generated command, or sequence of commands, over communication link 118 using receiver 112.

In step 208 of FIG. 2, remote-controlled device 104 will process and perform the received command, or sequence of commands, of step 206. For example, remote-controlled device 104 may power on or power off in response to the received command, or sequence of commands.

In step 210 of FIG. 2, URC 102 transmits a state change message over communication link 120 to remote-controlled device 104 using transceiver 108. In an embodiment, the state change message may represent the resulting state of remote-controlled device 104 after performance of the received command, or sequence of commands. For example, the state change message may represent the result of changing an input of remote-controlled device 104. In an embodiment, remote-controlled device 104 may receive the state change message over communication link 120 using transceiver 116.

In step 212 of FIG. 2, URC 102 receives a state change confirmation message over communication link 120 from remote-controlled device 104 using transceiver 108. In an embodiment, the state change confirmation message may represent whether remote-controlled device 104 successfully performed the received command, or sequence of commands, of step 206.

In step 214 of FIG. 2, URC 102 updates the stored state for remote-controlled device 104 in URC 102 based on whether the type of state change confirmation message received in step 212. In an embodiment, if the state change confirmation message represents the successful performance of the received command, or sequence of commands, of step 206 by remote-controlled device 104. URC 102 updates the stored state for remote-controlled device 104 in URC 102 to reflect the successful performance of the received command, or sequence of commands. In an embodiment, if the state change confirmation message represents the unsuccessful performance of the received command, or sequence of commands, of step 206 by remote-controlled device 104, URC 102 will not update the stored state for remote-controlled device 104 in URC 102. The conditional updating of the stored state for a remote-controlled device 104 in URC 102 ensures URC 102 does not become out of sync with the remote-controlled device 104.

Figure 3:
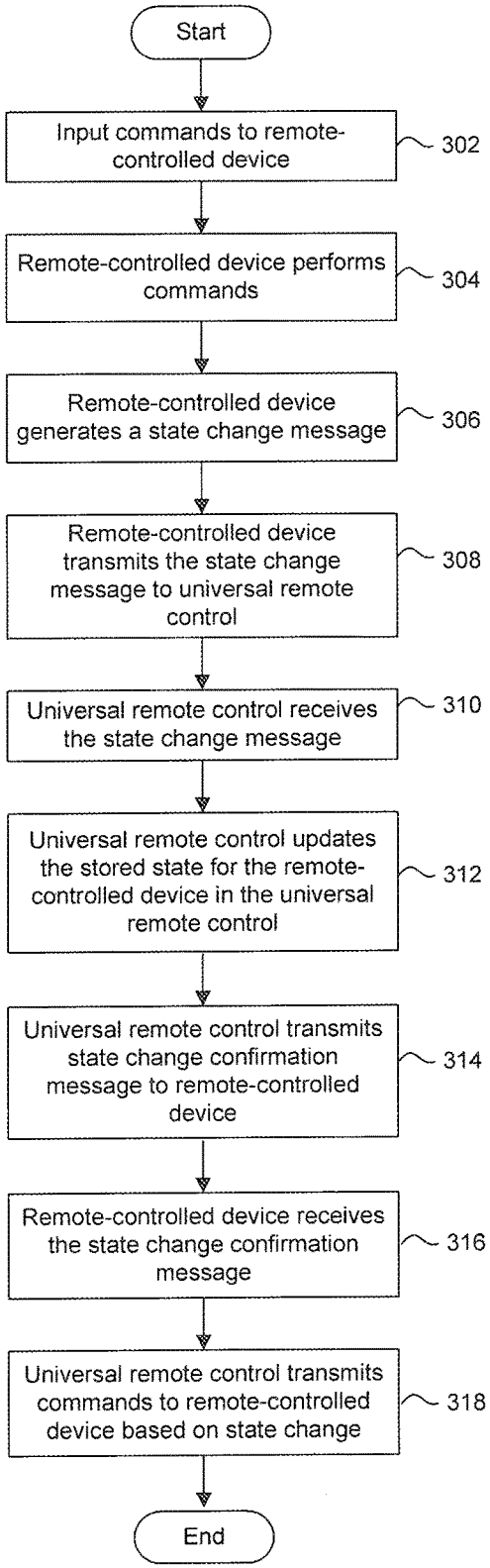
FIG. 3 is a flowchart illustrating a process for maintaining synchronization of a universal remote control with a remote-controlled device based on a state change at the remote-controlled device, according to an example embodiment.

FIG. 3 is a flowchart for a method 300 for maintaining synchronizing of a universal remote control with a remote-controlled device based on a state change at the remote-controlled device, according to an example embodiment. Method 300 is described with reference to FIG. 1. Method 300 can be performed by processing logic that can comprise hardware (e.g., circuitry, dedicated logic, programmable logic, microcode, etc.), software (e.g., instructions run on a processing device), or a combination thereof.

In step 302 of FIG. 3, a user inputs a command, or sequence of commands, directly at a remote-controlled device 104. In an embodiment, the user may input the command, or sequence of commands, by pressing one or more buttons on remote-controlled device 104. In another embodiment, the user may input the command, or sequence of commands, by using a touch screen on remote-controlled device 104. As would be appreciated by a person of ordinary skill in the art, the user may input the command, or sequence of commands, to remote-controlled device 104 using various other mechanisms.

In step 304 of FIG. 3, remote-controlled device 104 will process and perform the inputted command, or sequence of commands, of step 302. For example, remote-controlled device 104 may power on or power off in response to the inputted command, or sequence of commands.

In step 306 of FIG. 3, remote-controlled device 104 generates a state change message. In an embodiment, the state change message may represent the resulting state of remote-controlled device 104 after performance of the inputted command, or sequence of commands of step 302. For example, the state change message may represent the result of changing an input of remote-controlled device 104.

In step 308 of FIG. 3, remote-controlled device 104 transmits the generated state change message over communication link 120 to URC 102 using transceiver 116. In an embodiment, remote-controlled device 104 transmits the generated state change message to URC 102 based on pairing information stored in pairing database 118.

In step 310 of FIG. 3, URC 102 receives the generated state change message over communication link 120 from remote-controlled device 104 using transceiver 108.

In step 312 of FIG. 3, URC 102 updates the stored state for remote-controlled device 104 in URC 102 based on the state change message received in step 310.

In step 314 of FIG. 3, URC 102 transmits a state change confirmation message to remote-controlled device 104 over communication link 120 using transceiver 108. In an embodiment, the state change confirmation message may represent whether URC 102 successfully updated the stored state for remote-controlled device 104 in URC 102 to reflect the performance of the inputted command, or sequence of commands, of step 302 at remote-controlled device 104.

In step 316 of FIG. 3, remote-controlled device 104 receives the state change confirmation message over confirmation link 120 using transceiver 116. In an embodiment, if the state change confirmation message represents the unsuccessful updating of the stored state for remote-controlled device 104 in URC 102, remote-controlled device 104 may repeat step 308.

In step 318 of FIG. 3, URC 102 may transmit requests or commands to remote-controlled device 104 over communication link 118 to perform functions at remote-controlled device 104 that the state change of remote-controlled device 104. In an embodiment, URC 102 may transmit the requests or commands to remote-controlled device 104 over communication link 118 using transmitter 106.

Figure 4:
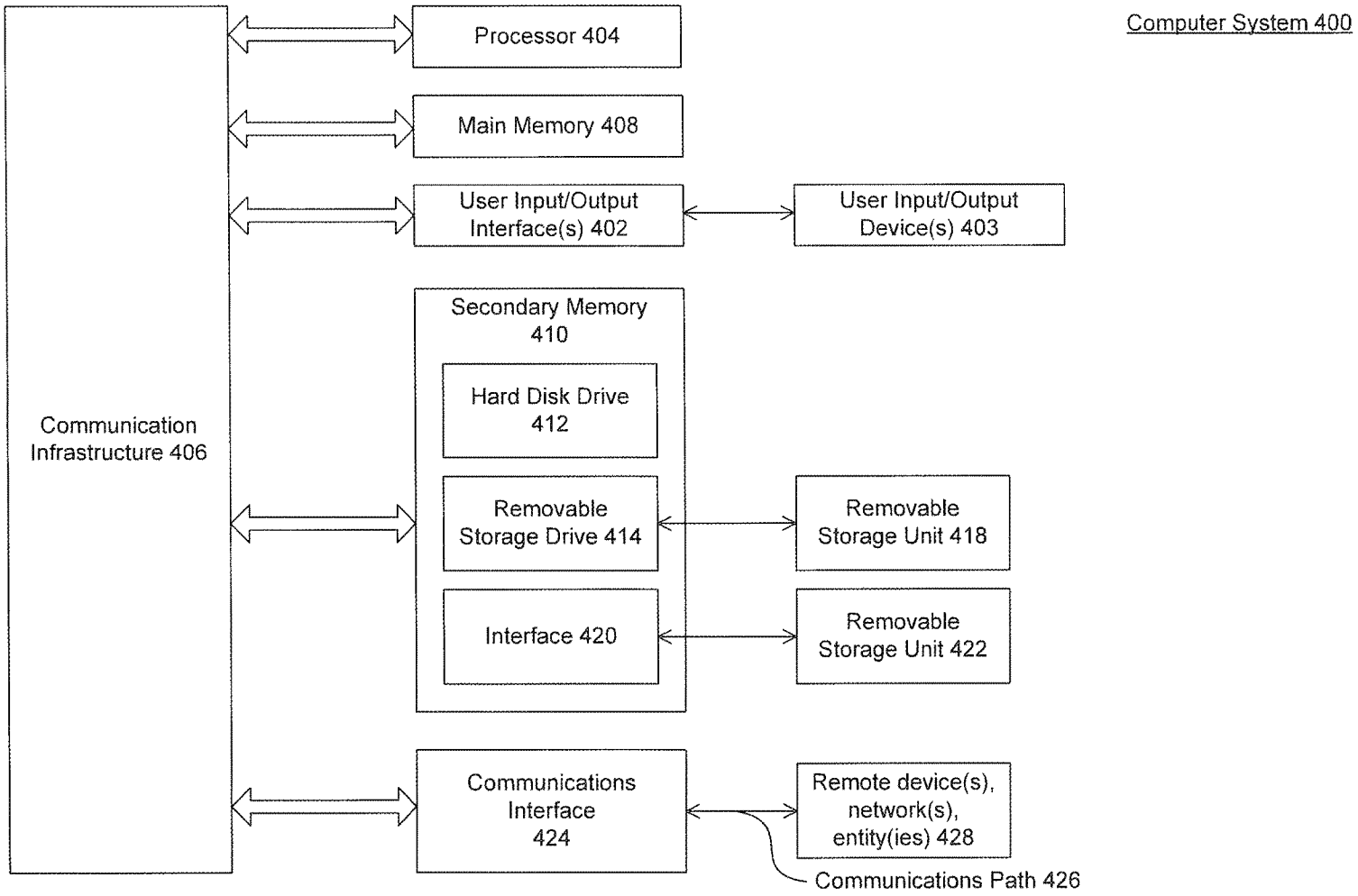
FIG. 4 is an example computer system useful for implementing various embodiments.

Various embodiments can be implemented, for example, using one or more well-known computer systems, such as computer system 400 shown in FIG. 4. Computer system 400 can be any well-known computer capable of performing the functions described herein.

Computer system 400 includes one or more processors (also called central processing units, or CPUs), such as a processor 404. Processor 404 is connected to a communication infrastructure or bus 406.

One or more processors 404 may each be a graphics processing unit (GPU). In an embodiment, a GPU is a processor that is a specialized electronic circuit designed to process mathematically intensive applications. The GPU may have a parallel structure that is efficient for parallel processing of large blocks of data, such as mathematically intensive data common to computer graphics applications, images, videos, etc.

Computer system 400 also includes user input/output device(s) 403, such as monitors, keyboards, pointing devices, etc., that communicate with communication infrastructure 406 through user input/output interface(s) 402.

Computer system 400 also includes a main or primary memory 408, such as random access memory (RAM). Main memory 408 may include one or more levels of cache. Main memory 408 has stored therein control logic (i.e., computer software) and/or data.

Computer system 400 may also include one or more secondary storage devices or memory 410. Secondary memory 410 may include, for example, a hard disk drive 412 and/or a removable storage device or drive 414. Removable storage drive 414 may be a floppy disk drive, a magnetic tape drive, a compact disk drive, an optical storage device, tape backup device, and/or any other storage device/drive.

Removable storage drive 414 may interact with a removable storage unit 418. Removable storage unit 418 includes a computer usable or readable storage device having stored thereon computer software (control logic) and/or data. Removable storage unit 418 may be a floppy disk, magnetic tape, compact disk, DVD, optical storage disk, and/any other computer data storage device. Removable storage drive 414 reads from and/or writes to removable storage unit 418 in a well-known manner.

According to an exemplary embodiment, secondary memory 410 may include other means, instrumentalities or other approaches for allowing computer programs and/or other instructions and/or data to be accessed by computer system 400. Such means, instrumentalities or other approaches may include, for example, a removable storage unit 422 and an interface 420. Examples of the removable storage unit 422 and the interface 420 may include a program cartridge and cartridge interface (such as that found in video game devices), a removable memory chip (such as an EPROM or PROM) and associated socket, a memory stick and USB port, a memory card and associated memory card slot, and/or any other removable storage unit and associated interface.

Computer system 400 may further include a communication or network interface 424. Communication interface 424 enables computer system 400 to communicate and interact with any combination of remote devices, remote networks, remote entities, etc. (individually and collectively referenced by reference number 428). For example, communication interface 424 may allow computer system 400 to communicate with remote devices 428 over communications path 426, which may be wired and/or wireless, and which may include any combination of LANs, WANs, the Internet, etc. Control logic and/or data may be transmitted to and from computer system 400 via communication path 426.

In an embodiment, a tangible apparatus or article of manufacture comprising a tangible computer useable or readable medium having control logic (software) stored thereon is also referred to herein as a computer program product or program storage device. This includes, but is not limited to, computer system 400, main memory 408, secondary memory 410, and removable storage units 418 and 422, as well as tangible articles of manufacture embodying any combination of the foregoing. Such control logic, when executed by one or more data processing devices (such as computer system 400), causes such data processing devices to operate as described herein.

Based on the teachings contained in this disclosure, it will be apparent to persons skilled in the relevant art(s) how to make and use embodiments of the invention using data processing devices, computer systems and/or computer architectures other than that shown in FIG. 4. In particular, embodiments may operate with software, hardware, and/or operating system implementations other than those described herein.

It is to be appreciated that the Detailed Description section, and not the Summary and Abstract sections (if any), is intended to be used to interpret the claims. The Summary and Abstract sections (if any) may set forth one or more but not all exemplary embodiments of the invention as contemplated by the inventor(s), and thus, are not intended to limit the invention or the appended claims in any way.

While the invention has been described herein with reference to exemplary embodiments for exemplary fields and applications, it should be understood that the invention is not limited thereto. Other embodiments and modifications thereto are possible, and are within the scope and spirit of the invention. For example, and without limiting the generality of this paragraph, embodiments are not limited to the software, hardware, firmware, and/or entities illustrated in the figures and/or described herein. Further, embodiments (whether or not explicitly described herein) have significant utility to fields and applications beyond the examples described herein.

Embodiments have been described herein with the aid of functional building blocks illustrating the implementation of specified functions and relationships thereof. The boundaries of these functional building blocks have been arbitrarily defined herein for the convenience of the description. Alternate boundaries can be defined as long as the specified functions and relationships (or equivalents thereof) are appropriately performed. Also, alternative embodiments may perform functional blocks, steps, operations, methods, etc. using orderings different than those described herein.

References herein to "one embodiment," "an embodiment," "an example embodiment," or similar phrases, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it would be within the knowledge of persons skilled in the relevant art(s) to incorporate such feature, structure, or characteristic into other embodiments whether or not explicitly mentioned or described herein.

The breadth and scope of the invention should not be limited by any of the above-described exemplary embodiments, but should be defined only in accordance with the following claims and their equivalents.

What is claimed is:

1. A computer implemented method for maintaining state synchronization for a universal remote control, comprising:

generating a first device command at the universal remote control to control a remote-controlled device based at least in part on a user input;

sending, via a first communications link, the first device command to the remote-controlled device for performance by the remote-controlled device;

sending, via a second communications link, a state change to the remote-controlled device based at least in part on the sending the first device command, wherein the state change represents a resulting state of the remote-controlled device after performance of the first device command;

receiving, via the second communications link, a confirmation message at the universal remote control from the remote-controlled device in response to the sending the state change;

programming the universal remote control based at least in part on the received confirmation message; and sending, via the first communications link, a second device command for controlling the remote-controlled device based at least in part on the programming.

2. The method of claim 1, wherein the second communications link is a bidirectional communication link that uses a radio frequency signal.

3. The method of claim 1, wherein the first communications link is a unidirectional communication link that uses an infrared signal.

4. The method of claim 1, the programming further comprising:

updating, at the universal remote, a state configuration for the remote-controlled device based at least in part on the sent state change.

5. The method of claim 1, wherein the universal remote control is programmed to send the second device command via the first communications link based at least in part on a command set for the remote-controlled device.

6. The method of claim 1, wherein the remote-controlled device is a television or set top box.

7. The method of claim 1, further comprising outputting a confirmation based at least in part on the programing.

8. A system, comprising:

a transceiver configured to:

send, via a first communications link, a state change to the remote-controlled device based at least in part on a first device command sent to the remote-controlled device, wherein the state change represents a resulting state of the remote-controlled device after performance of the first device command;

receive, via the first communications link, a confirmation message from the remote-controlled device in response to the sending the state change;

a memory configured to store a command set for the remote-controlled device and a state configuration for the remote-controlled device;

at least one processor coupled to the memory and configured to:

generate the first device command to control the remote-controlled device based at least in part on a user input; and program the state configuration for the remote-controlled device based at least in part on the received confirmation message; and a transmitter configured to:

send, via a second communications link, the first device command to the remote-controlled device for performance by the remote-controlled device; and send, via the second communications link, a second device command for controlling the remote-controlled device based at least in part on the programming.

9. The system of claim 8, wherein the first communications link is a bidirectional communication link that uses a radio frequency signal.

10. The system of claim 8, the at least one processor further configured to:

update the state configuration for the remote-controlled device based at least in part on the sent state change.

11. The system of claim 8, wherein the transmitter is configured to send the second device command via the second communications link based at least in part on the stored command set for the remote-controlled device.

12. The system of claim 8, wherein the remote-controlled device is a television or set top box.

13. The system of claim 8, the at least one processor further configured to:

output a confirmation based at least in part on the programing.

14. A tangible computer-readable device having instructions stored thereon that, when executed by at least one computing device, causes the at least one computing device to perform operations comprising:

performing a first device command at a remote-controlled device based at least in part on a user input;

sending, via a first communications link, a state change for the remote-controlled device to a universal remote control based at least in part on the performing the first device command;

receiving, via the first communications link, a confirmation message at the remote-controlled device in response to the sending the state change;

determining the universal remote control updated a stored state configuration for the remote-controlled device based at least in part on the received confirmation message; and enabling receiving, via a second communications link, a second device command for controlling the remote-controlled device from the universal remote control based at least in part on the determining.

15. The tangible computer-readable device of claim 14, wherein the first communications link is a bidirectional communication link that uses a radio frequency signal.

16. The tangible computer-readable device of claim 14, wherein the second communications link is a unidirectional communication link that uses an infrared signal.

17. The tangible computer-readable device of claim 14, the sending further comprising:

sending, via the first communications link, the state change for the remote-controlled device to the universal remote control based at least in part on pairing information stored at the remote-controlled device.

18. The tangible computer-readable device of claim 14, wherein the universal remote control is programmed to send the second device command via the second communications link based at least in part on a command set for the remote-controlled device.

19. The tangible computer-readable device of claim 14, wherein the remote-controlled device is a television or set top box.

20. The tangible computer-readable device of claim 14, the operations further comprising:

outputting a confirmation based at least in part on the determining.

* * * * *